United States Patent [19]

Christopher et al.

[11] Patent Number: 4,875,413

[45] Date of Patent: Oct. 24, 1989

[54] APPARATUS FOR PERFORATING WELLS

[75] Inventors: Glenn B. Christopher, Ft. Worth; Jerry D. Motley, Arlington, both of Tex.

[73] Assignee: Jet Research Center, Inc., Mansfield, Tex.

[21] Appl. No.: 278,695

[22] Filed: Nov. 30, 1988

[51] Int. Cl.[4] ..... F42B 1/02; E21B 43/119

[52] U.S. Cl. ..... 102/307; 102/312; 102/313; 175/4.51

[58] Field of Search ..... 102/307, 312, 313; 175/4.51, 4.52

[56] References Cited

U.S. PATENT DOCUMENTS

| | | | |
|---|---|---|---|
| 4,273,047 | 6/1981 | Remmer | 102/310 |
| 4,716,833 | 1/1988 | Regalbuto | 102/312 X |
| 4,739,707 | 4/1988 | Regalbuto et al. | 102/307 |
| 4,739,839 | 4/1988 | Regalbuto et al. | 175/4.52 |
| 4,800,815 | 1/1989 | Appledorn et al. | 102/313 X |

*Primary Examiner*—Peter A. Nelson

*Attorney, Agent, or Firm*—Robert A. Kent; C. C. Dougherty, Jr.

[57] ABSTRACT

Improved apparatus for perforating a subterranean formation penetrated by a well bore comprised of at least one encapsulated shaped charge held in the well bore adjacent the formation by a charge carrier optionally selected from a wire carrier or a metal strip carrier. The encapsulated shaped charge includes an ignition end and a capped discharge end, the ignition end having an extension providing cavities for containing opposed portions of a pair of wires. The capped discharge end includes a threaded extension whereby the encapsulated shaped charge can optionally be threadedly attached to a complementary threaded opening in a metal strip carrier. A wire carrier adapter nut is threadedly attached to the capped discharge end extension which provides cavities for containing opposed portions of a pair of additional wires of a four-wire carrier.

20 Claims, 2 Drawing Sheets

APPARATUS FOR PERFORATING WELLS

BACKGROUND OF THE INVENTION

1. Field of the Invention

The present invention relates generally to apparatus for perforating wells, and more particularly, to apparatus for perforating wells comprised of one or more encapsulated shaped charges held by a wire or strip carrier.

2. Description of the Prior Art

A variety of apparatus have heretofore been developed and used for forming openings known as perforations in wells which extend from the well bores into subterranean formations penetrated thereby. Generally, the perforating apparatus is assembled with a plurality of shaped explosive charges and lowered in a well bore to a position adjacent a subterranean formation to be perforated. Upon the detonation of the shaped charges, elongated explosive jets are formed which produce perforations through any casing, liner, cement, or the like in the well bore and into the subterranean formation adjacent the well bore. The perforations form flow passages through which hydrocarbons flow from the subterranean formation into the well bore.

Well perforating apparatus have heretofore been comprised of a plurality of encapsulated shaped charges held in spaced relationship one above the other by wires or metal strips. Such perforating apparatus is most often used where it is necessary or desirable to lower the perforating apparatus in the well bore through a relatively small diameter tubing string already disposed in the well bore. The shaped charges generally include a closed ignition end and an open discharge end. A cap is sealingly attached over the discharge end, and the thus encapsulated shaped charges are attached to a wire or metal strip carrier by attachment means formed on the charges.

Wire carriers have heretofore been comprised of two pairs of substantially parallel wires having adjacent bends formed therein at intervals therealong for accepting complementary structure including wire containing cavities formed at the ignition and capped discharge ends of the encapsulated shaped charges. Metal strip carriers are comprised of elongated metal strips having threaded openings spaced therealong for receiving complementary threaded extensions at the capped discharge ends of the encapsulated shaped charges.

Depending upon the particular type of well being perforated, the characteristics of the subterranean formation and other factors including the well operator's preference, either a wire carrier or a metal strip carrier may be utilized in perforating any particular well. As a result, it has heretofore been necessary for the perforating apparatus operator to have available both encapsulated shaped charges adapted for attachment to a wire carrier, i.e., charges having structure formed at the ignition and capped discharge ends containing cavities for receiving wires, and encapsulated shaped charges adapted for attachment to a metal strip carrier, i.e., charges having complementary threaded structure at the capped discharge ends thereof.

By the present invention, an improved apparatus for perforating wells is provided comprised of an encapsulated shaped charge which can optionally be used with either wire or metal strip carriers.

SUMMARY OF THE INVENTION

An improved apparatus for perforating a subterranean formation penetrated by a well bore is provided. The apparatus comprises a shaped charge having a discharge end and an ignition end, the ignition end including an extension providing cavities for containing opposed portions of a pair of wires of a wire carrier and an opening for attaching detonation initiating means thereto. A cap is sealingly attached to the shaped charge over the discharge end thereof which includes a threaded extension whereby the cap and shaped charge can optionally be threadedly attached to a complementary threaded opening in a metal strip carrier and held at a desired position within the well bore thereby. A wire carrier adapter nut is threadedly attached to the threaded cap extension which provides cavities for containing opposed portions of an additional pair of wires whereby the cap and the shaped charge can be attached to a four-wire carrier and held at a desired position within the well bore thereby.

It is, therefore, a general object of the present invention to provide an improved apparatus for perforating wells.

A further object of the present invention is the provision of an improved encapsulated shaped charge apparatus for perforating a subterranean formation which can optionally be used with either a wire carrier or a metal strip carrier.

Other and further objects, features and advantages of the present invention will be readily apparent to those skilled in the art upon a reading of the description of preferred embodiments which follows when taken in conjunction with the accompanying drawing.

DESCRIPTION OF THE PREFERRED EMBODIMENTS

Figure 3:
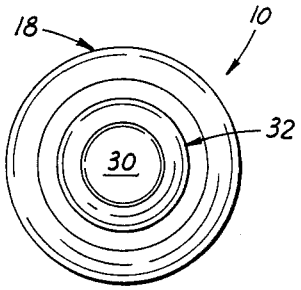
FIG. 3 is an end view taken along line 3—3 of FIG. 1.
Figure 4:
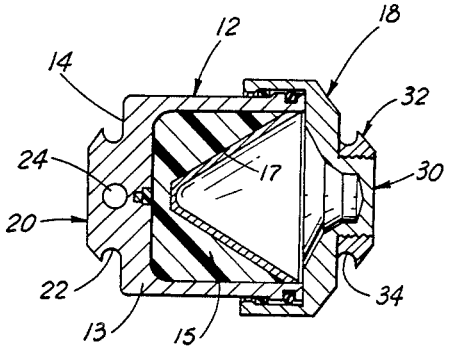
FIG. 4 is a cross-sectional view taken along line 4—4 of FIG. 1.
Figure 5:
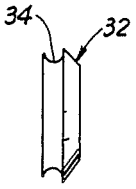
FIG. 5 is a side view of the wire carrier adapter nut of the present invention.
Figure 6:
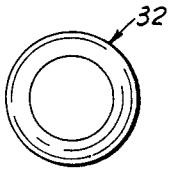
FIG. 6 is an end view of the adapter nut of FIG. 5.

Referring now to the drawings and particularly to FIGS. 1 through 8, the encapsulated shaped charge perforating apparatus of the present invention is illustrated and generally designated by the numeral 10. The apparatus 10 is comprised of a substantially cylindrical shaped charge 12 having a rearward ignition end 14 and a forward discharge end 16 (FIG. 4). A substantially cylindrical cap 18 is sealingly attached to the shaped charge 12 over the forward discharge end 16 thereof. The cap to case configuration of the shaped charge 12 is more fully described in U.S. patent application Ser. No. 145,077 filed Jan. 19, 1988, now U.S. Pat. No. 4,817,531, and assigned to the assignee of this application, which is incorporated herein by reference.

As shown best in FIG. 4, the shaped charge 12 is comprised of a substantially cylindrical housing 13 having an explosive material 15 disposed therein. A conical liner 17 retains the explosive material within the housing 13 and imparts a shape to the explosive material which results in the formation of an elongated explosive jet upon detonation thereof.

The housing 13 of the shaped charge 12 includes an extension 20 at the ignition end 14 thereof. The extension 20 is a substantially cylindrical protuberance which includes an annular recess 22 formed in the periphery thereof. As will be described further herein, the annular recess 22 provides cavities for containing opposed portions of a pair of wires of a wire carrier. A passage 24 is provided in the extension 20 for connecting detonation initiating means, e.g., a detonating cord (not shown) thereto. The passage 24 is positioned transversely through the extension 20 with the opposite ends thereof opening into the recess 22.

Figure 1:
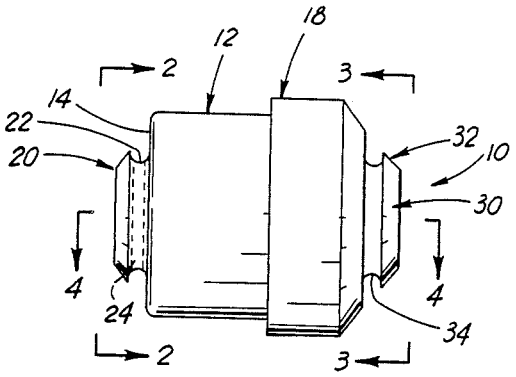
FIG. 1 is a side elevational view of an encapsulated shaped charge of the present invention.
Figure 2:
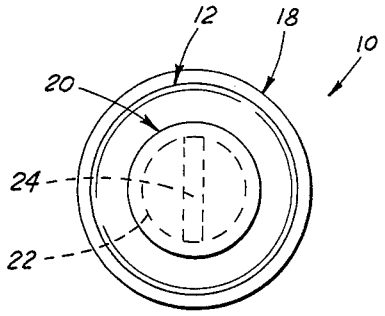
FIG. 2 is an end view taken along line 2—2 of FIG. 1.
Figure 7:
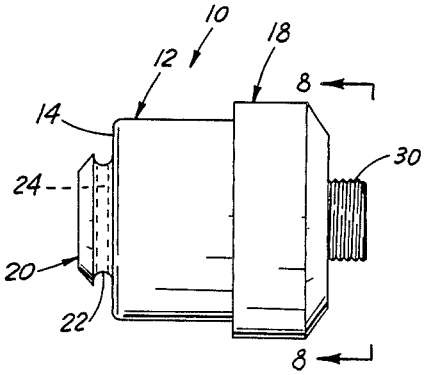
FIG. 7 is a side elevational view of the encapsulated shaped charge of FIG. 1 with the wire carrier adapter nut removed therefrom.
Figure 8:
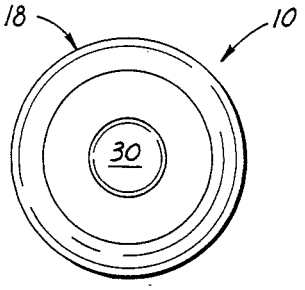
FIG. 8 is an end view taken along line 8—8 of FIG. 7.

The cap 18 which is sealingly attached over the discharge end 16 of the shaped charge 12 includes a threaded extension 30. As best shown in FIGS. 1, 3 and 4, when the encapsulated shaped charge 10 is utilized with a wire carrier, a wire carrier adapter nut 32 is threadedly connected to the threaded extension 30. The adapter nut 32 is annular in shape and includes a continuous recess 34 in the periphery thereof. The recess 34 provides cavities for containing opposed portions of a second pair of wires of a wire carrier. When the adapter nut 32 is removed from the threaded extension 30 at the capped end of the encapsulated shaped charge 30 as shown in FIGS. 7 and 8, the charge 30 can be threadedly connected by means of the threaded extension 30 to a complementary threaded opening in a metal strip carrier. In the presently preferred embodiment of the invention illustrated in the drawings, the opposed extensions 24 and 30 of the charge 10 are positioned coaxially with each other as well as with the charge 10.

Figure 9:
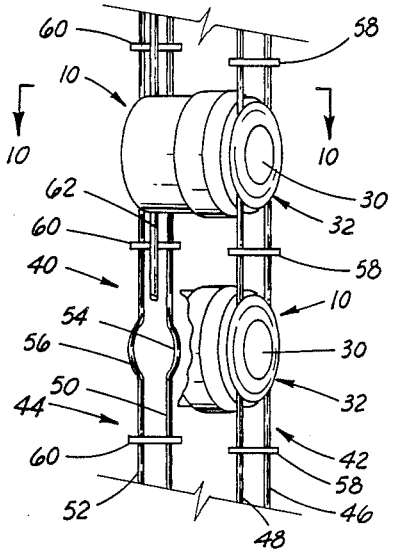
FIG. 9 is a perspective view of two encapsulated charges like those illustrated in FIG. 1 held by a four-wire carrier.
Figure 10:
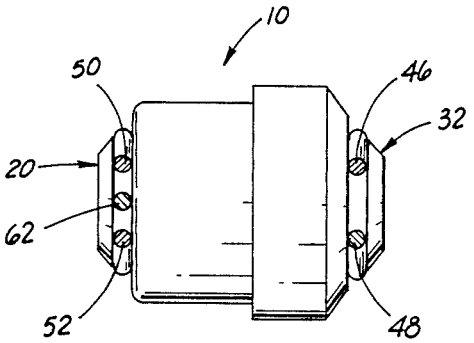
FIG. 10 is a top view taken along line 10—10 of FIG. 9.

Referring now to FIGS. 9 and 10, two encapsulated shaped charges 10 having wire carrier adapter nuts 32 connected thereto are shown attached to a four-wire carrier, generally designated by the numeral 40. The four-wire carrier 40 is comprised of two pairs 42 and 44 of substantially parallel wires which include adjacent and complementary bent portions. That is, the pairs of wires 42 and 44 are comprised of wires 46, 48 and 50, 52, respectively. At spaced intervals therealong the wires include complementary bent portions for receiving the extensions 20 and the extensions 30 with adapter nuts 32 attached thereto of two or more charges 10. For example and as shown in FIGS. 9 and 10, the wires 50 and 52 include opposing bent portions 54 and 56 for receiving the annular cavities formed by the recesses 22 in the extensions 20 of the charges 10. Each pair of wires 42 and 44 includes a plurality of connectors 58 and 60, respectively, which maintain the wires together.

As will be understood by those skilled in the art, the wire carrier 40 can and usually does include more than two encapsulated shaped charges 10. The particular number of charges 10 utilized depends upon the number of perforations to be produced in a particular well which in turn depends upon a variety of factors including the height of the subterranean formation to be perforated.

In operation of the assembly illustrated in FIGS. 9 and 10 comprised of two or more shaped charges 10 held by the four-wire carrier 40, each of the charges 10 is connected to adjacent bent portions of the pairs of wires 42 and 44. That is, the bent portions 54 and 56 of the wires 50 and 52 are connected within the cavities formed by the recesses 22 of the extensions 20 of the charges 10, and adjacent bent portions of the wires 46 and 48 are connected into the cavities formed by the recesses 34 of the wire carrier adapter nuts 32 connected to the threaded extensions 30 of the charges 10. The connectors 58 and 60 of the pairs of wires 42 and 44 maintain the bent portions of the wires in place within the wire receiving cavities of the charges 10. Once the charges 10 have been connected to the four-wire carrier 40, a detonating cord 62 is serially connected to the extensions 20 at the ignition ends 14 thereof by successively passing the detonating cord through the passages 24 disposed within the extensions 20. The completed assembly is lowered in a well bore penetrating a subterranean formation to be perforated using conventional means to a position adjacent the formation whereupon the detonation of the detonating cord 62 is initiated which in turn causes the detonation of the charges 10. Upon detonation, the charges 10 form elongated explosive jets which penetrate the ends of the extensions 30 of the caps 18, materials disposed within the well bore and the subterranean formation.

Figure 11:
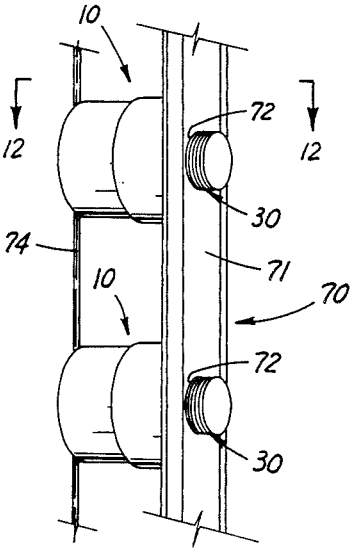
FIG. 11 is a perspective view of two encapsulated charges like those illustrated in FIG. 7 held by a metal strip carrier.
Figure 12:
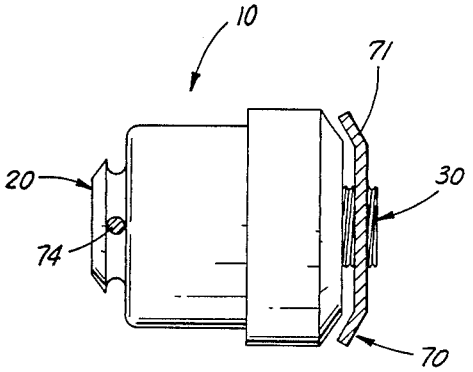
FIG. 12 is a top view taken along line 12—12 of FIG. 11.

Referring now to FIGS. 11 and 12, when it is desirable or necessary to use a metal strip carrier 70 in lieu of the four-wire carrier 40 described above, encapsulated shaped charges 10 with the wire carrier adapter nut 32 removed therefrom are utilized. The metal strip carrier 70 is comprised of an elongated metal strip 71 having a plurality of threaded openings 72 spaced therealong. The threaded extensions 30 of each of the charges 10 are threadedly connected to threaded openings 72 in the strip carrier 70. A detonating cord 74 is serially connected to the extensions 20 of the charges 10 by successively passing the detonating cord 74 through the passages 24 in the extensions 20 of the charges 10. Once assembled, the strip carrier 70, charges 10 and detonating cord 74 are lowered into a well bore and the charges are detonated to form perforations in the same manner as described above in connection with the four-wire carrier 40.

Thus, the present invention is well adapted to carry out the objects and attain the ends and advantages mentioned as well as those inherent therein. While certain preferred arrangements of the apparatus have been illustrated for the purposes of this disclosure, numerous changes in such arrangements and in the construction of parts may be made by those skilled in the art, which changes are encompassed within the scope and spirit of the present invention as defined by the appended claims.

What is claimed is:

1. Apparatus for perforating a subterranean formation penetrated by a well bore comprising:

a shaped charge having a discharge end and an ignition end, the ignition end including an extension providing cavities for containing opposed portions of a pair of wires of a wire carrier and a passage for connecting detonation initiating means thereto;

a cap sealingly attached to said shaped charge over the discharge end thereof, said cap including a threaded extension whereby said cap and shaped charge can optionally be threadedly attached to a complementary threaded opening in a metal strip carrier and held at a desired position within said well bore thereby; and a wire carrier adapter nut threadedly attached to said threaded cap extension, said adapter nut providing cavities for containing opposed portions of an additional pair of wires whereby said cap and said shaped charge can be attached to a four-wire carrier and held at a desired position within said well bore thereby.

2. The perforating apparatus of claim 1 wherein said ignition end extension of said shaped charge is comprised of a substantially cylindrical protuberance having an annular recess in the periphery thereof which forms said cavities therein.

3. The perforating apparatus of claim 2 wherein said wire carrier adapter nut includes an annular recess in the periphery thereof which forms said cavities therein.

4. The perforating apparatus of claim 1 wherein said detonation initiating means passage is disposed in said ignition end extension of said shaped charge transversely to the axis of said shaped charge.

5. The perforating apparatus of claim 4 wherein said detonation initiating means is comprised of a detonating cord which is connected to said passage by passing therethrough.

6. The perforating apparatus of claim 1 wherein said shaped charge and said cap are substantially cylindrical.

7. The perforating apparatus of claim 6 wherein said shaped charge extension and said cap extension are positioned coaxially.

8. In an apparatus for perforating a subterranean formation penetrated by a well bore comprised of at least one encapsulated shaped charge connected to a detonating cord and held in said well bore adjacent said subterranean formation by a charge carrier, the improvement whereby said encapsulated shaped charge can optionally be held by a wire or metal strip charge carrier comprising:

said encapsulated shaped charge having a capped discharge end and an ignition end, the ignition end including an extension providing cavities for containing opposed portions of a pair of wires of a wire carrier;

said capped discharge end including a threaded extension whereby said encapsulated shaped charge can optionally be threadedly attached to a complementary threaded opening in a metal strip carrier and held at a desired position within said well bore thereby; and a wire carrier adapter nut threadedly attached to said capped discharge end extension, said adapter nut providing cavities for containing opposed portions of an additional pair of wires whereby said encapsulated shaped charge can be attached to a four-wire carrier and held at a desired position within said well bore thereby.

9. The perforating apparatus of claim 8 wherein said ignition end extension is comprised of a substantially cylindrical protuberance having a recess in the periphery thereof which forms said cavities therein.

10. The perforating apparatus of claim 9 wherein said wire carrier adapter nut includes an annular recess in the periphery thereof which forms said cavities therein.

11. The perforating apparatus of claim 10 wherein said ignition end extension is further characterized to include a passage formed therein to which said detonating cord is connected.

12. The perforating apparatus of claim 11 wherein said detonating cord is connected to said passage by passing therethrough.

13. The perforating apparatus of claim 8 wherein said encapsulated shaped charge is substantially cylindrical.

14. The perforating apparatus of claim 13 wherein said ignition end extension and said capped discharge end extension are positioned coaxially.

15. In an apparatus for perforating a subterranean formation penetrated by a well bore comprising a plurality of encapsulated substantially cylindrical shaped charges serially connected by a detonating cord and held in spaced relationship one above the other by a charge carrier, the improvement whereby said encapsulated shaped charges can optionally be held by a wire or metal strip carrier comprising:

each of said encapsulated shaped charges having a capped discharge end and an ignition end, the ignition end including an extension providing cavities for containing opposed portions of two wires of a four-wire carrier;

said capped discharge ends of each of said encapsulated shaped charges including a threaded extension whereby said encapsulated shaped charge can optionally be threadedly attached to a complementary threaded opening in a metal strip carrier and held at a desired position within said well bore thereby; and each of said encapsulated shaped charges including a wire carrier adapter nut threadedly attached to said threaded capped discharge end extension providing cavities for containing opposed portions of two additional wires of said four-wire carrier whereby said encapsulated shaped charge can be attached to a four-wire carrier and held at a desired position within said well bore thereby.

16. The perforating apparatus of claim 15 wherein said ignition end extensions of said encapsulated shaped charges are each comprised of a substantially cylindrical protuberance having an annular recess in the periphery thereof which forms said cavities therein.

17. The perforating apparatus of claim 16 wherein each of said wire, carrier adapter nuts includes an annular recess in the periphery thereof which forms said cavities therein.

18. The perforating apparatus of claim 15 wherein each of said encapsulated shaped charges includes a passage formed in the ignition end extension thereof to which said detonating cord is connected.

19. The perforating apparatus of claim 18 wherein said detonating cord is connected to said passage by passing therethrough.

20. The perforating apparatus of claim 19 wherein said ignition end extension and said capped discharge end extension are positioned coaxially.

* * * * *